US010013917B2

(12) United States Patent
Kim et al.

(10) Patent No.: US 10,013,917 B2
(45) Date of Patent: Jul. 3, 2018

(54) PANEL DRIVING DEVICE AND ORGANIC LIGHT EMITTING DISPLAY DEVICE HAVING THE SAME

(71) Applicant: SAMSUNG DISPLAY CO., LTD., Yongin-si, Gyeonggi-Do (KR)

(72) Inventors: Jong-Soo Kim, Suwon-si (KR); Myoung-Seop Song, Asan-si (KR); Dong-Wan Park, Gumi-si (KR); Sang-Hun Park, Cheonan-si (KR)

(73) Assignee: Samsung Display Co., Ltd., Yongin-Si, Gyeonggi-do (KR)

( * ) Notice: Subject to any disclaimer, the term of this patent is extended or adjusted under 35 U.S.C. 154(b) by 0 days.

(21) Appl. No.: 14/854,545

(22) Filed: Sep. 15, 2015

(65) Prior Publication Data

US 2016/0247451 A1 Aug. 25, 2016

(30) Foreign Application Priority Data

Feb. 24, 2015 (KR) ..... 10-2015-0025503

(51) Int. Cl.
*G09G 3/32* (2016.01)
*G09G 3/3258* (2016.01)
(Continued)

(52) U.S. Cl.
CPC ..... *G09G 3/3258* (2013.01); *G09G 3/3233* (2013.01); *G09G 3/3696* (2013.01); *G09G 2300/043* (2013.01); *G09G 2300/0861* (2013.01); *G09G 2310/0294* (2013.01); *G09G 2310/08* (2013.01); *G09G 2320/0276* (2013.01); *G09G 2320/043* (2013.01); *G09G 2320/045* (2013.01)

(58) Field of Classification Search
CPC ... G09G 2310/0205; G09G 2310/0208; G09G 2310/021; G09G 3/3275
See application file for complete search history.

(56) References Cited

U.S. PATENT DOCUMENTS

2006/0221015 A1* 10/2006 Shirasaki ..... G09G 3/325 345/77
2006/0255994 A1* 11/2006 Lin ..... G09G 3/3688 341/144
(Continued)

FOREIGN PATENT DOCUMENTS

JP 2003-098998 A 4/2003
KR 10-2011-0024451 A 3/2011
(Continued)

OTHER PUBLICATIONS

European Search Report dated Apr. 29, 2016 in Corresponding European Patent Application No. 16157105.4.
European Office Action dated Mar. 13, 2018 from the European Patent Office for European Patent Application No. 16157105.4.

*Primary Examiner* — Kevin M Nguyen
(74) *Attorney, Agent, or Firm* — Lee & Morse, P.C.

(57) ABSTRACT

A panel driving device includes a voltage generator and a data driver. The voltage generator generates a compensation voltage set and a gamma voltage set and selectively outputs the compensation voltage set or the gamma voltage set. The data driver outputs a reference voltage based on the compensation voltage set and outputs pixel data voltage based on the gamma voltage set.

20 Claims, 5 Drawing Sheets

(51) Int. Cl.
*G09G 3/3233* (2016.01)
*G09G 3/36* (2006.01)

(56) References Cited

U.S. PATENT DOCUMENTS

| | | | | |
|---|---|---|---|---|
| 2008/0048935 | A1* | 2/2008 | Yoshioka | G09G 3/3688 345/55 |
| 2008/0074362 | A1* | 3/2008 | Ogura | G09G 3/3275 345/77 |
| 2008/0180295 | A1* | 7/2008 | Lan | H03M 1/76 341/148 |
| 2008/0225036 | A1* | 9/2008 | Song | G09G 3/3611 345/213 |
| 2009/0189924 | A1* | 7/2009 | Ogura | G09G 3/3233 345/690 |
| 2014/0139565 | A1 | 5/2014 | Choi | |
| 2015/0145849 | A1 | 5/2015 | Choi et al. | |
| 2015/0170609 | A1* | 6/2015 | Jung | G09G 3/20 345/212 |
| 2015/0243220 | A1* | 8/2015 | Kim | H01L 27/1225 345/215 |

FOREIGN PATENT DOCUMENTS

| | | | |
|---|---|---|---|
| KR | 10-1058111 | B1 | 8/2011 |
| KR | 10-2014-0087214 | A | 7/2014 |
| KR | 10-2014-0137504 | A | 12/2014 |
| WO | WO 2006/104259 | A1 | 10/2006 |

* cited by examiner

PANEL DRIVING DEVICE AND ORGANIC LIGHT EMITTING DISPLAY DEVICE HAVING THE SAME

CROSS REFERENCE TO RELATED APPLICATION

Korean Patent Application No. 10-2015-0025503, filed on Feb. 24, 2015, and entitled "Panel Driving Device and Organic Light Emitting Display Device Having The Same," is incorporated by reference herein in its entirety.

BACKGROUND

1. Field

One or more embodiments described herein relate to a panel driving device and an organic light emitting display device having a panel driving device.

2. Description of the Related Art

An organic light emitting display generates images using organic light emitting diodes. Each diode has an organic layer between an anode and a cathode. In operation, holes from the anode combine with electrons from the cathode in the organic layer to emit light.

Over time, the threshold voltages of driving transistors in the pixels of the display may vary. In an attempt to prevent degradation of display quality, each pixel may include a circuit to compensate the threshold voltage. The compensation circuit may compensate the threshold voltage by charging a capacitor with a voltage that corresponds to the threshold voltage in one horizontal period. However, in a high resolution display or a display driven at high driving frequency, the time for compensating the threshold voltage may be insufficient.

SUMMARY

In accordance with one or more embodiments, an organic light emitting display device includes a display panel including a plurality of scan lines, a plurality of data lines crossing the scan lines, and a plurality of pixels; a scan driver to simultaneously provide a scan signal to the scan lines in a first period and a second period and to progressively provide the scan signal to the scan lines in a third period; a voltage generator to generate a compensation voltage set and a gamma voltage set, to output the compensation voltage set in the first period and the second period, and to output the gamma voltage set in the third period; a data driver to output a reference voltage to the data lines based on the compensation voltage set and to output a pixel data voltage to the data lines based on the gamma voltage set; and a controller to control the scan driver, the voltage generator, and the data driver.

The voltage generator may include a compensation voltage generator to generate the compensation voltage set by distributing a plurality of compensation reference voltages by a first resistance string; a gamma voltage generator to generate the gamma voltage set by distributing a plurality of gamma reference voltages by a second resistance string; and a voltage selector to select the compensation voltage set in the first period and the second period and to select the gamma voltage set in the third period.

The first resistance string may include a plurality of resistances connected in series, and magnitudes of the resistances may be substantially equal to each other. The second resistance string may include a plurality of resistances connected in series, and magnitudes of the resistances may be different from each other. The voltage selector may select the compensation voltage set or the gamma voltage set based on a voltage set control signal from the controller.

The data driver may include a shift register to shift a horizontal start signal synchronizing a data clock signal to generate a sampling signal; a latch circuit to latch input data based on the sampling signal and to output the latched input data based on a load signal; a digital-analog converter to set the reference voltage based on the compensation voltage set and to convert the latched input data into the pixel data voltage based on the gamma voltage set; and an output buffer to output the reference voltage or the pixel data voltage to the data lines. The display device may include an emission driver to provide a first emission signal and a second emission signal to the pixels.

Each of the pixels may include an organic light emitting diode; a first transistor to control a driving current based on a first node signal of a first node, the driving current to be provided from a first power terminal to which a first power voltage is applied to the organic light emitting diode, a second transistor between one of the data lines and the first node, the second transistor to be turned on based on the scan signal; a first capacitor between the first power terminal and a second node connected to a first electrode of the first transistor; a second capacitor between the first node and the second node; and a third transistor between the first power terminal and the second node and to be turned on based on the first emission signal. The reference voltage may be set to a voltage level to turn on the first transistor.

Each of the pixels may include a fourth transistor between an initialization terminal to which an initialization voltage is applied and a first electrode of the organic light emitting diode, the fourth transistor to be turned on based on the scan signal. The initialization voltage may be set to a voltage level to turn off the organic light emitting diode.

Each pixel may include a fifth transistor between a second electrode of the first transistor and a first electrode of the organic light emitting diode, the fifth transistor to be turned on based on the second emission signal. The emission driver may output the first emission signal in the first period and the second emission signal in the second period.

The reference voltage may include a red color reference voltage for red color pixels, a green color reference voltage for green color pixels, and a blue color reference voltage for blue color pixels. The gamma voltage set may include a red color gamma voltage set for red color pixels, a green color gamma voltage set for green color pixels, and a blue color gamma voltage set for blue color pixels.

In accordance with one or more other embodiments, a panel driving device includes a voltage generator to generate a compensation voltage set and a gamma voltage set and to selectively output the compensation voltage set or the gamma voltage set; and a data driver to output a reference voltage based on the compensation voltage set and to output a pixel data voltage based on the gamma voltage set.

The voltage generator may include a compensation voltage generator to generate the compensation voltage set by distributing a plurality of compensation reference voltages by a first resistance string; a gamma voltage generator to generate the gamma voltage set by distributing a plurality of gamma reference voltages by a second resistance string; and a voltage selector to select the compensation voltage set in a threshold voltage compensating period for a driving transistor and the gamma voltage set in a pixel data writing period.

The first resistance string may include a plurality of resistances connected in series, and magnitudes of the resistances may be substantially equal to each other. The second resistance string may include a plurality of resistances connected in series and magnitudes of the resistances be different from each other. The data driver may include a shift register o shift a horizontal start signal synchronizing a data clock signal to generate a sampling signal; a latch circuit to latch input data based on the sampling signal and to output the latched input data based on a load signal; a digital-analog converter to set the reference voltage based on the compensation voltage set and to convert the latched input data to the pixel data voltage based on the gamma voltage set; and an output buffer to output the reference voltage or the pixel data voltage.

BRIEF DESCRIPTION OF THE DRAWINGS

Features will become apparent to those of skill in the art by describing in detail exemplary embodiments with reference to the attached drawings in which.

DESCRIPTION OF EMBODIMENTS

Figure 1:
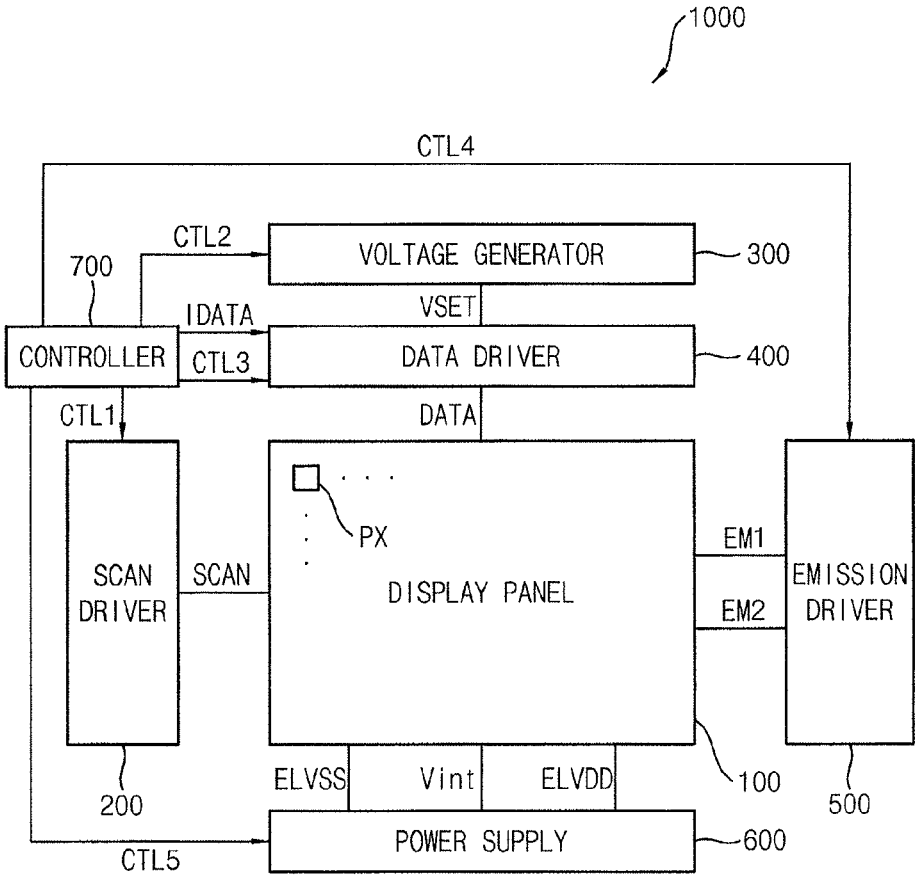
FIG. 1 illustrates an embodiment of an organic light emitting display device.

Example embodiments are described hereinafter with reference to the drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments. Like reference numerals refer to like elements throughout.

FIG. 1 illustrates an embodiment of an organic light emitting display device 1000 which includes a display panel 100, a scan driver 200, a voltage generator 300, a data driver 400, an emission driver 500, a power supply 600, and a controller 700.

The display panel 100 includes a plurality of scan lines, a plurality of data lines crossing the scan lines, and a plurality of pixels PX. The scan lines are connected to the scan driver 200. The data lines are connected to the data driver 400. The display panel 100 includes n*m pixels PX arranged at locations corresponding to crossing points of the scan lines and the data lines. The display panel 100 further includes first emission lines and second emission lines connected to the emission driver 500, and power lines connected to the power supply 600.

The scan driver 200 may simultaneously provide a scan signal SCAN to the scan lines in a first period and a second period, and may progressively provide the scan signal SCAN to the scan lines in a third period. In one example embodiment, the first period may be an initialization period for initializing the pixels PX. The second period may be a threshold voltage compensating period for compensating the threshold voltage of a driving transistor. The third period may be a pixel data writing period for progressively outputting a pixel data voltage to the pixels PX in synchronization with the scan signal SCAN.

The voltage generator 300 generates a compensation voltage set and a gamma voltage set. The voltage generator 300 may output the compensation voltage set or the gamma voltage set as a voltage set VSET. The voltage generator 300 may output the compensation voltage set in the first period and the second period and may output the gamma voltage set in the third period. The compensation voltage set may be used to generate the reference voltage for compensating the threshold voltage of the driving transistor. Thus, the reference voltage may be set based on the compensation voltage set.

For example, a register value may be set to generate the reference voltage with a certain voltage level. The gamma voltage set may correspond to a gamma curve. The voltage generator 300 may therefore independently generate the compensation voltage set and the gamma voltage set. In at least one embodiment, even though gamma reference voltages are adjusted to adjust the gamma voltage set after the reference voltage is set, the reference voltage may not be changed.

The voltage generator 300 sets the reference voltage and the gamma voltage set for each color of light to be emitted. In one example embodiment, the reference voltage may include a red color reference voltage for red color pixels, a green color reference voltage for green color pixels, and a blue color reference voltage for blue color pixels. In one example embodiment, the gamma voltage set may include a red color gamma voltage set for red color pixels, a green color gamma voltage set for green color pixels, and a blue color gamma voltage set for blue color pixels.

The data driver 400 provides the reference voltage or the pixel data voltage as the data signal DATA to the data lines. The data driver 400 may output the reference voltage to the data lines based on the compensation voltage set, and may output the pixel data voltage to the data lines based on the gamma voltage set. Because the voltage generator 300 outputs the compensation voltage set in the first period and the second period, the data driver 400 may output the reference voltage to the data lines based on the compensation voltage set in the first period and the second period. Because the voltage generator 300 outputs the gamma voltage set in the third period, the data driver 400 may output the pixel data voltage to the data lines based on the gamma voltage set in the third period.

The emission driver 500 provides a first emission signal EM1 and a second emission signal EM2 to the pixels PX via the first emission lines and the second emission lines. In one example embodiment, the emission driver 500 may output the first emission signal EM1 and the second emission signal EM2 in the first period to initialize the pixels PX. The emission driver 500 may output the second emission signal EM2 in the second period to compensate the threshold voltage of the driving transistor.

The power supply 600 provides a first power voltage ELVDD (e.g., a high power voltage), a second power voltage ELVSS (e.g., a low power voltage), and an initialization voltage Vint to the pixels PX via the power lines.

The controller 700 generates first through fifth control signals CTL1 through CTL5 to control the scan driver 200, the voltage generator 300, the data driver 400, the emission driver 500, and the power supply 600. In one example embodiment, the second control signal CTL2 provided to the voltage generator 300 may include a voltage set control signal. In one example embodiment, the third control signal CTL3 provided to the data driver 400 may include a horizontal start signal and a data clock signal.

Therefore, the organic light emitting display device 1000 may independently generate or adjust the compensation voltage set and the gamma voltage set. As a result, a luminance change may be reduced or prevented by changing the gamma voltage set, to thereby improve display quality.

Figure 2:
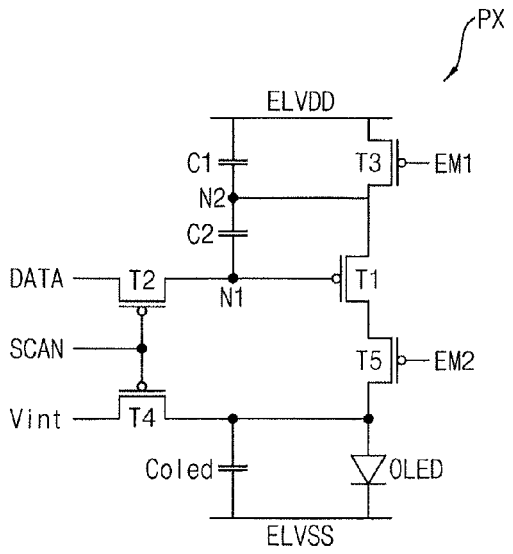
FIG. 2 illustrates an embodiment of a pixel.
Figure 3:
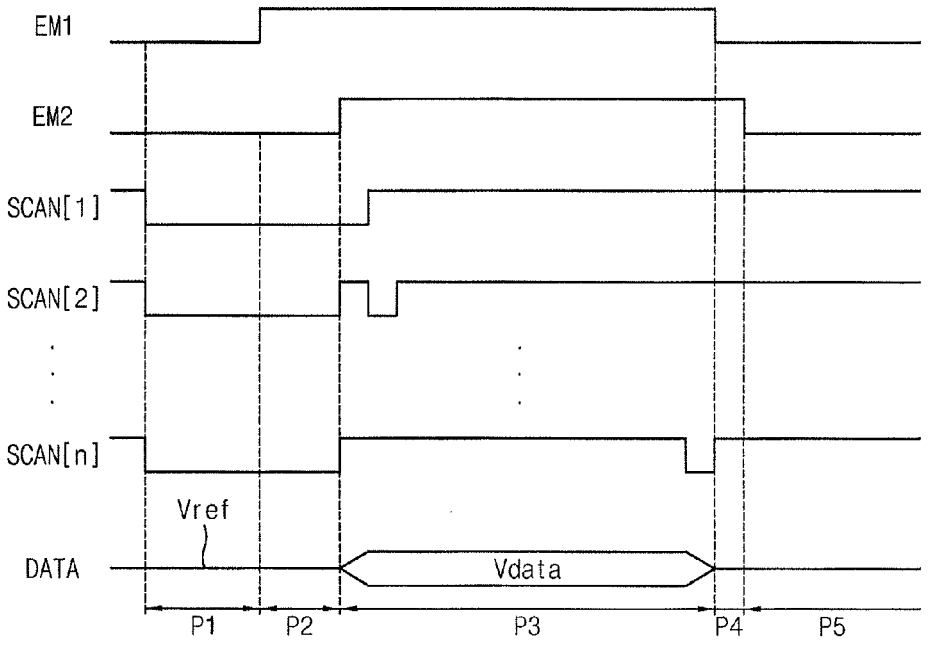
FIG. 3 illustrates an example of control signals for the pixel.

FIG. 2 illustrates an embodiment of a pixel PX, which, for example, may be representative of the pixels in the organic light emitting display device of FIG. 1. FIG. 3 illustrates an example of control signals for the pixel PX. In this embodiment, the threshold voltages of the pixels PX in the display device may be simultaneously compensated in a threshold voltage compensating period. Therefore, a sufficient time for compensating the threshold voltages may be secured, for example, in comparison with a method for progressively compensating the threshold voltages.

Referring to FIG. 2, the pixel PX includes an organic light emitting diode OLED, first through fifth transistors T1 through T5, a first capacitor C1, and a second capacitor C2. The first transistor T1 is a driving transistor located between a second node N2 and a first electrode of the fifth transistor T5. The first transistor T1 controls driving current based on a first node signal of a first node N1. The driving current is provided from a first power terminal, to which a first power voltage ELVDD is applied, to the organic light emitting diode OLED, The second transistor T2 is between one of the data lines and the first node N1. The second transistor T2 is turned on based on the scan signal SCAN. The second transistor T2 applies a reference voltage or a pixel data voltage as the data signal DATA to the first node N1 based on the scan signal SCAN. The reference voltage may be set to a voltage level at which the first transistor T1 is turned on in order to compensate the threshold voltage of the first transistor T1.

The third transistor T3 is between the first power terminal and the second node N2, and is turned on based on the first emission signal EM1. The third transistor T3 applies the first power voltage ELVDD to the second node N2 based on the first emission signal EM1.

The fourth transistor T4 is between an initialization terminal to which an initialization voltage Vint is applied and a first electrode of the organic light emitting diode OLED. The fourth transistor T4 is turned on based on the scan signal SCAN. The fourth transistor T4 applies the initialization voltage Vint to the first electrode of the organic light emitting diode OLED based on the scan signal SCAN to initialize the organic light emitting diode OLED. The initialization voltage Vint may be set to a voltage level at which the organic light emitting diode OLED is turned off.

The fifth transistor T5 is between a second electrode of the first transistor T1 and the first electrode of the organic light emitting diode OLED. The fifth transistor T5 is turned on based on the second emission signal EM2. The fifth transistor T5 may control the flow of current to the initialization terminal based on the second emission signal EM2, in order to charge the second capacitor C2 to a voltage corresponding to the threshold voltage. Also, the fifth transistor T5 may provide the driving current to the organic light emitting diode OLED based on the second emission signal EM2.

The second capacitor C2 is between the first node N1 and the second node N2, and stores a voltage corresponding to the pixel data voltage or threshold voltage of the first transistor T1.

The first capacitor C1 is between the first power terminal and the second node N2 and has a predetermined capacitance to allow the second capacitor C2 to store a voltage corresponding to the pixel data voltage or threshold voltage of first transistor T1.

The organic light emitting diode OLED emits light based on the driving current.

Referring to FIG. 3, a first emission signal EM1 is provided to first emission line in a first period P1. Scan signals SCAN[1] through SCAN[N] may be simultaneously provided to scan lines in the first period P1. The reference voltage Vref is provided to the data lines in the first period P1. In one example embodiment, the reference voltage Vref may be set to a voltage level to turn on the first transistor T1.

When the first emission signal EM1 is provided to the first emission line, the third transistor T3 is turned on and the first power voltage ELVDD is applied to the second node N2.

When the scan signal SCAN is provided to the scan lines, the second transistor T2 and the fourth transistor T4 are turned on. When the second transistor T2 is turned on, the reference voltage Vref is applied to the first node N1 from the data lines. When the fourth transistor T4 is turned on, the initialization voltage Vint is applied to the first electrode of the organic light emitting diode OLED to initialize the organic light emitting diode OLED. Also, a diode capacitor Coled, which is connected to the organic light emitting diode OLED in parallel, may be initialized. In one example embodiment, the diode capacitor Coled may be a parasitic capacitor.

The second emission signal EM2 is provided to the second emission lines in the second period P2. The scan signals SCAN[1] through SCAN[n] are provided to the scan lines in the second period P2. The reference voltage Vref is provided to the data lines in the second period P2. When the second emission signal EM2 is provided to the second emission line, the fifth transistor T5 is turned on and the second electrode of the first transistor T1 is electrically connected to the second electrode of the fourth transistor T4.

Because the reference voltage Vref is applied to the first node N1 and the fourth transistor T4 is turned on, current flows from the second node N2 to the initialization terminal via the first transistor T1, the fifth transistor T5, and the fourth transistor T4. The voltage of the second node N2 may decrease from the first power voltage ELVDD to a voltage that corresponds to the sum of the reference voltage Vref and the threshold voltage of the first transistor T1. When the voltage of the second node N2 is set as the sum of the reference voltage Vref and the threshold voltage of the first transistor T1, the first transistor T1 is turned off. Therefore, the second capacitor C2 may store a voltage corresponding to the threshold voltage of the first transistor T1.

The scan signals SCAN[1] through SCAN[n] may be progressively provided to the scan lines in the third period P3. The pixel data voltage Vdata synchronized with the scan signals SCAN[1] through SCAN[n] is provided to the data lines in third period P3.

When the scan signal SCAN is provided to the scan lines, the second transistor T2 and the fourth transistor T4 are turned on. When the second transistor T2 is turned on, the pixel data voltage Vdata is applied to the first node N1 from the data lines. When the pixel data voltage Vdata is applied to the first node N1, a voltage of the first node N1 is changed from the reference voltage Vref to the pixel data voltage Vdata. A voltage of the second node N2 may be changed corresponding to the voltage of the first node N1. The voltage of the second node N2 may be changed according to a ratio of a capacitance of the first capacitor C1 by a capacitance the second capacitor C2. Therefore, the second capacitor C2 may store a voltage according to the threshold voltage of the first transistor T1 or the pixel data voltage Vdata.

The first emission signal EM1 is provided to the first emission line in the fourth period P4. The third transistor T3 is turned on in the fourth period P4. When the third transistor T3 is turned on, the first power voltage ELVDD is applied to the second node N2. In this case, the first node N1 is set in a floating state. Hence, the second capacitor C2 stably maintains the voltage charged in the previous period.

The second emission signal EM2 is provided to the second emission line in the fifth period P5. The fifth transistor T5 is turned on in the fifth period P5. When the fifth transistor T5 is turned on, the first transistor T1 controls the driving current based on the voltage stored in the second capacitor C2, and the driving current is provided to the organic light emitting diode OLED.

The organic light emitting display device may simultaneously compensate the threshold voltage of the pixels in the second period P2. Therefore, the compensation time for compensating the threshold voltage may be stably secured by sufficiently allocating the second period P2.

In the example embodiment of FIG. 3, the threshold voltages of all pixels are simultaneously compensated. In another embodiment, the scan lines may be divided into predetermined blocks, and the threshold voltages of pixels for each block are simultaneously compensated. In this case, the pixels are driven for each block.

Figure 4:
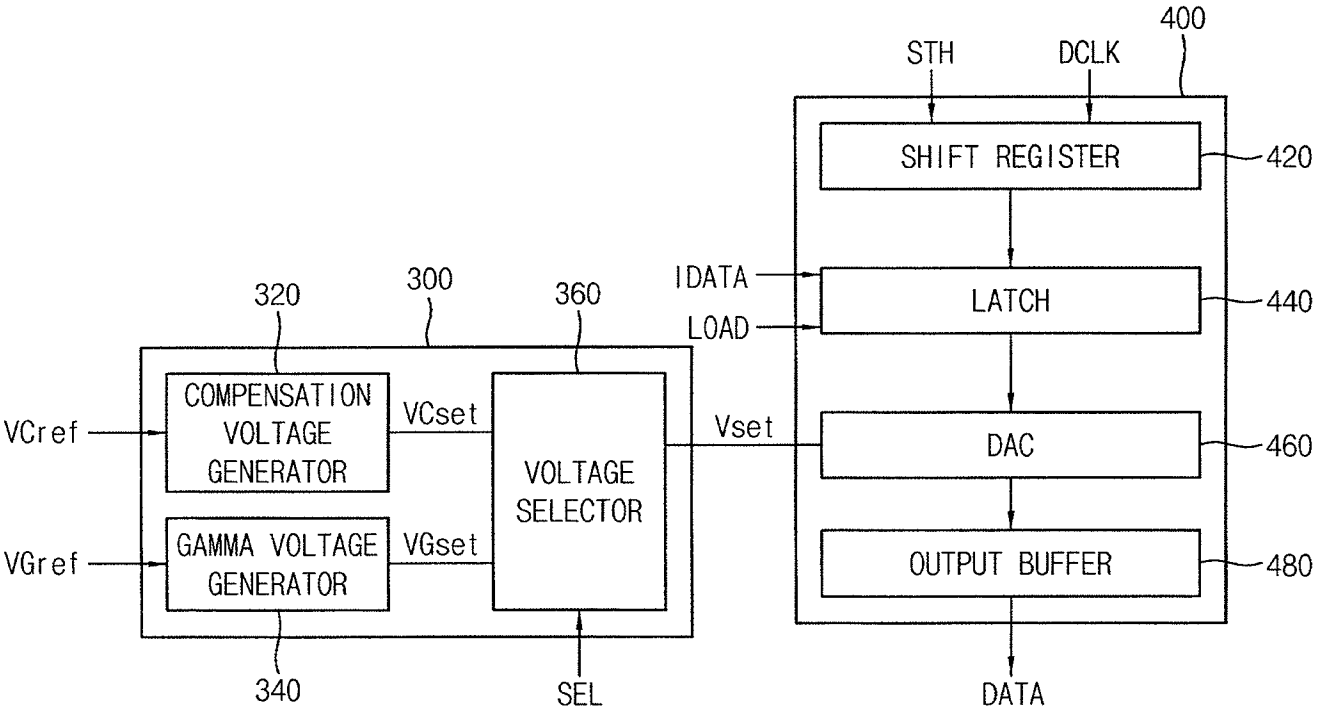
FIG. 4 illustrates an embodiment of a voltage generator and a data driver.

FIG. 4 illustrates an embodiment of a voltage generator and a data driver, which, for example, may be included in the organic light emitting display device of FIG. 1.

Referring to FIG. 4, the voltage generator 300 may include a compensation voltage generator 320, a gamma voltage generator 340, and a voltage selector 360. The compensation voltage generator 320 generates a compensation voltage set VCset by distributing a plurality of compensation reference voltages VCref by a first resistance string. The compensation reference voltages VCref may be used to set a reference voltage for compensating the threshold voltage of the driving transistor. In one example embodiment, the first resistance string may include a plurality of resistances connected in series. Magnitudes of the resistances in the first resistance string may substantially equal to each other.

The gamma voltage generator 340 may generate a gamma voltage set VGset by distributing a plurality of gamma reference voltages VGref by a second resistance string. The gamma voltage set VGset may correspond to the gamma curve. In one example embodiment, the second resistance string includes a plurality of resistances connected in series. Magnitudes of the resistances in the second resistance string may be different from each other.

The voltage selector 360 may selectively output the compensation voltage set VCset or the gamma voltage set VGset as a voltage set Vset. The voltage selector 360 may select the compensation voltage set VCset in the first period (e.g., an initialization period) and the second period (e.g., a threshold voltage compensating period). The voltage selector 360 may select the gamma voltage set VGset in the third period (e.g., a pixel data writing period). In one example embodiment, the voltage selector 360 may select the compensation voltage set VCset or the gamma voltage set VGset based on a voltage set control signal SEL from the controller.

The data driver 400 includes a shift register 420, a latch circuit 440, a digital-analog converter 460, and an output buffer 480. The shift register 420 receives a horizontal start signal STH and a data clock signal DCLK. The shift register 420 shifts the horizontal start signal STH synchronizing the data clock signal DCLK to generate a sampling signal.

The latch circuit 440 latches input data IDATA based on the sampling signal, and outputs the latched input data based on a load signal LOAD.

The digital-analog converter 460 sets the reference voltage based on the compensation voltage set VCset as the voltage set Vset. A register value may be set in order to generate the reference voltage with a certain voltage level. Also, the digital-analog converter 460 may convert the latched input data into the pixel data voltage based on the gamma voltage set VGset as the voltage set Vset.

The output buffer 480 provides the reference voltage or the pixel data voltage as the data signal DATA to the data lines.

In the example embodiment of FIG. 4, the data driver 400 includes the shift register 420, the latch circuit 440, the digital-analog converter 460, and the output buffer 480. In another embodiment, one or more of the shift register 420, the latch circuit 440, the digital-analog converter 460, and the output buffer 480 may be separate from the data driver 400.

Figure 5:
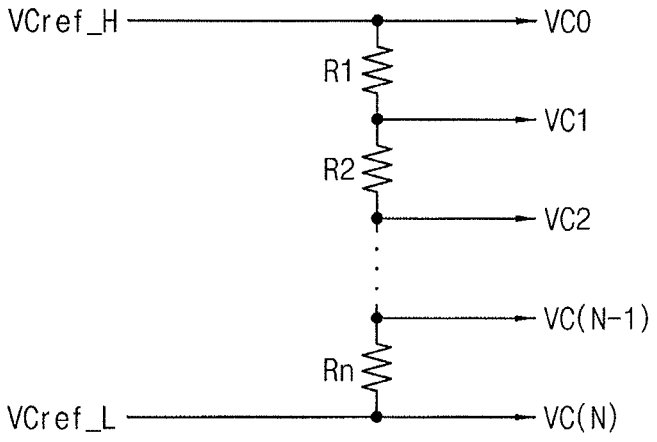
FIG. 5 illustrates an embodiment of a resistance string in the voltage generator.

FIG. 5 illustrates an embodiment of a first resistance string, which, for example, may be included in the voltage generator of FIG. 4. Referring to FIG. 5, the first resistance string distributes a plurality of compensation reference voltages to generate compensation voltage set. The first resistance string includes a plurality of resistances connected in series. Magnitudes of the resistances in the first resistance string may be equal to each other.

Because the reference voltage is provided for initializing the pixel and for compensating the threshold voltage, the reference voltage may be set using the compensation voltage set generated by the first resistance string. For example, the first compensation reference voltage VCref_H and the second compensation reference voltage VCref_L may be applied to the first resistance string. The first resistance string may include first through (N)th resistances R1 through Rn that are connected in series. Magnitudes of the first resistance R1 through (N)th resistance Rn may substantially equal to each other. The first resistance string may distribute the first compensation reference voltage VCref_H and the second compensation reference voltage VCref_L using the first resistance R1 through the (N)th resistance Rn. As a result, the compensation voltages VC0 through VCn are linearly generated to form the compensation voltage set.

Figure 6:
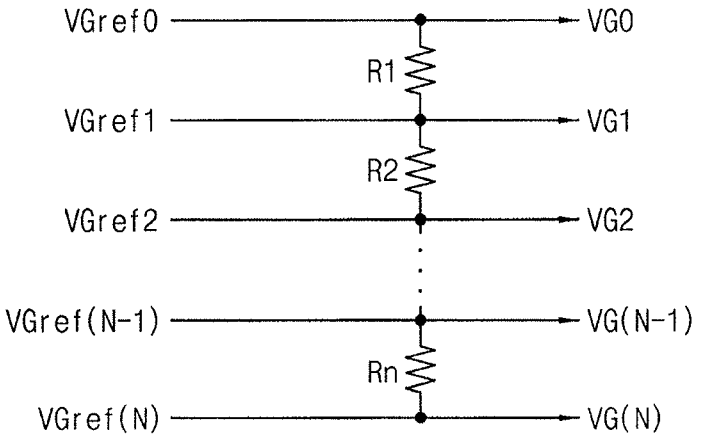
FIG. 6 illustrates an embodiment of another resistance string in the voltage generator.

FIG. 6 illustrates an embodiment of a second resistance string, which, for example, may be included in the voltage generator of FIG. 4. Referring to FIG. 6, the second resistance string distributes a plurality of gamma reference voltages to generate a gamma voltage set. The second resistance string include a plurality of resistances connected in series. Magnitudes of the resistances in the second resistance string may be different from each other.

The gamma voltage set may be adjusted, for example, based on a standard gamma curve based on a gamma value of 2.2. Therefore, the gamma voltages VG0 through VGn in the gamma voltage set may be non-linearly generated. For example, a (0)th gamma reference voltage VGref_0 through a (N)th the gamma reference voltage VGref_N may be applied to the second resistance string. The second resistance string includes a first resistance R1 through a (N)th resistance Rn connected in series. Magnitudes of the first resistance R1 through the (N)th resistance Rn may be different from each other. Therefore, the second resistance string may distribute the (0)th gamma reference voltage VGref_0 through the (N)th the gamma reference voltage VGref_N using the first resistance R1 through the (N)th resistance Rn. As a result, the gamma voltages VG0 through VGn are generated in a non-linear manner as the gamma voltage set, e.g., a gamma curve.

Figure 7:
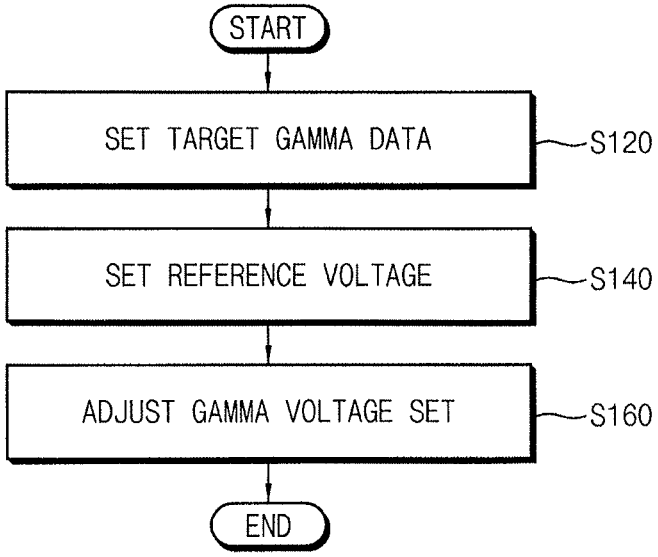
FIG. 7 illustrates an embodiment of a method for setting gamma data.

FIG. 7 illustrates an embodiment of a method for setting a gamma data in an organic light emitting display device, for example, as set forth in FIG. 1. Referring to FIG. 7, the organic light emitting display device may perform a multi-time programmable (MTP) operation and may set the gamma data. The MTP operation may repeatedly perform post-correction in luminance and color coordinate for respective pixels. Thus, the MTP operation may adjust the image quality of the organic light emitting display device to reach a target quality level.

Referring to FIG. 7, the method includes setting target gamma data (operation S120), setting a reference voltage (operation S140), and adjusting the gamma voltage set (operation S160).

In a comparative organic light emitting display device, the reference voltage and gamma voltage may be generated using the same resistance string. In this case, the reference voltage and the gamma voltage may be affected by each other. For example, the reference voltage may be determined by setting a register value based on the gamma voltage set. When the gamma reference voltages applied to the resistance string are adjusted, in order to adjust the gamma voltage set after the reference voltage was set, the reference voltage may change.

In an organic light emitting display device that compensates threshold voltage using the reference voltage, driving current may be calculated based on Equation 1.

$$1d = \frac{\beta}{2}\left[\frac{1}{2}(Vref - Vdata)\right]^2 \quad (1)$$

where Id is the driving current, β is a constant value, Vref is the reference voltage, and Vdata is a pixel data voltage.

Thus, the driving current may be determined by the pixel data voltage and the reference voltage. Therefore, in the comparative organic light emitting display device, a luminance change may occur by changing the reference voltage because the driving current may change by changing the reference voltage.

However, in accordance with one or more embodiments, the compensation voltage set and the gamma voltage set may be independently generated using the voltage generator. Therefore, even though the gamma reference voltages applied to the resistance string are adjusted to adjust the gamma voltage set after the reference voltage was set, the reference voltage may not be changed.

Therefore, the organic light emitting display device independently sets the compensation voltage set and the gamma voltage set, thereby preventing a luminance change from occurring when the gamma voltage set is adjusted. In addition, the organic light emitting display device does not require a memory to store a look-up table for independently setting the reference voltage, thereby reducing manufacturing cost.

In the aforementioned embodiments, the transistors are implemented as p-type metal oxide semiconductor (PMOS) transistors. In another embodiment, NMOS transistors may be used.

The embodiments described herein may be applied to an electronic device having an organic light emitting display device. Examples of the electronic device include a cellular phone, a smart phone, a smart pad, and a personal digital assistant.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controller and other processing features of the disclosed embodiments may be implemented in logic which, for example, may include hardware, software, or both. When implemented at least partially in hardware, the controller and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controller and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. An organic light emitting display device, comprising:

a display panel including a plurality of scan lines, a plurality of data lines crossing the scan lines, and a plurality of pixels;

a scan driver to simultaneously provide a scan signal to the scan lines in a first period and a second period and to progressively provide the scan signal to the scan lines in a third period;

a voltage generator to generate a compensation voltage set and a gamma voltage set independently from one another based on different resistor strings, the compensation voltage set including a plurality of compensation voltages having a first voltage distribution to compensate for one or more driving transistor threshold voltages, the gamma voltage set including a plurality of gamma reference voltages having a second voltage distribution different from the first voltage distribution, the voltage generator to output the compensation voltage set in the first period and the second period and to output the gamma voltage set in the third period;

a data driver to determine a reference voltage based on the compensation voltage set and a register value, to output the reference voltage to the data lines in the first period and the second period, to convert input data into a pixel data voltage based on the gamma voltage set, and to output a pixel data voltage to the data lines based on the gamma voltage set in the third period; and a controller to control the scan driver, the voltage generator, and the data driver.

2. The display device as claimed in claim 1, wherein the voltage generator includes:

a compensation voltage generator to generate the compensation voltage set including the plurality of compensation reference voltages by distributing a plurality of compensation reference voltages by a first resistance string;

a gamma voltage generator to generate the gamma voltage set by distributing a plurality of gamma reference voltages by a second resistance string; and a voltage selector to select the compensation voltage set in the first period and the second period and to select the gamma voltage set in the third period.

3. The display device as claimed in claim 2, wherein:

the first resistance string includes a plurality of resistances connected in series, and magnitudes of the resistances are substantially equal to each other.

4. The display device as claimed in claim 2, wherein:

the second resistance string includes a plurality of resistances connected in series, and magnitudes of the resistances are different from each other.

5. The display device as claimed in claim 2, wherein the voltage selector is to select the compensation voltage set or the gamma voltage set based on a voltage set control signal from the controller.

6. The display device as claimed in claim 1, wherein the data driver includes:

a shift register to shift a horizontal start signal synchronizing a data clock signal to generate a sampling signal;

a latch circuit to latch the input data based on the sampling signal and to output the latched input data based on a load signal;

a digital-analog converter to set the reference voltage based on the compensation voltage set and to convert the latched input data into the pixel data voltage based on the gamma voltage set; and an output buffer to output the reference voltage or the pixel data voltage to the data lines.

7. The display device as claimed in claim 1, further comprising:

an emission driver to provide a first emission signal and a second emission signal to the pixels.

8. The display device as claimed in claim 7, wherein each of the pixels includes:

an organic light emitting diode;

a first transistor to control a driving current based on a first node signal of a first node, the driving current to be provided from a first power terminal to which a first power voltage is applied to the organic light emitting diode, a second transistor between one of the data lines and the first node, the second transistor to be turned on based on the scan signal;

a first capacitor between the first power terminal and a second node connected to a first electrode of the first transistor;

a second capacitor between the first node and the second node; and a third transistor between the first power terminal and the second node and to be turned on based on the first emission signal.

9. The display device as claimed in claim 8, wherein the reference voltage is set to a voltage level to turn on the first transistor.

10. The display device as claimed in claim 8, wherein each of the pixels includes: a fourth transistor between an initialization terminal to which an initialization voltage is applied and a first electrode of the organic light emitting diode, the fourth transistor to be turned on based on the scan signal.

11. The display device as claimed in claim 10, wherein the initialization voltage is set to a voltage level to turn off the organic light emitting diode.

12. The display device as claimed in claim 8, wherein each of the pixels includes: a fifth transistor between a second electrode of the first transistor and a first electrode of the organic light emitting diode, the fifth transistor to be turned on based on the second emission signal.

13. The display device as claimed in claim 12, wherein the emission driver is to output the first emission signal in the first period and is to output the second emission signal in the second period.

14. The display device as claimed in claim 1, wherein the reference voltage includes a red color reference voltage for red color pixels, a green color reference voltage for green color pixels, and a blue color reference voltage for blue color pixels.

15. The display device as claimed in claim 1, wherein the gamma voltage set includes a red color gamma voltage set for red color pixels, a green color gamma voltage set for green color pixels, and a blue color gamma voltage set for blue color pixels.

16. A panel driving device, comprising:

a voltage generator to generate a compensation voltage set and a gamma voltage set independently from one another based on different resistor strings and to selectively output the compensation voltage set or the gamma voltage set, the compensation voltage set including a plurality of compensation voltages having a first voltage distribution to compensate for one or more driving transistor threshold voltages and the gamma voltage set including a plurality of gamma reference voltages having a second voltage distribution different from the first voltage distribution; and a data driver to determine a reference voltage based on the compensation voltage set and a register value, to convert input data into a pixel data voltage based on the gamma voltage set, and to selectively output either the determined reference voltage or the pixel data voltage.

17. The panel driving device as claimed in claim 16, wherein the voltage generator includes:

a compensation voltage generator to generate the compensation voltage set including the plurality of compensation reference voltages by distributing a plurality of compensation reference voltages by a first resistance string;

a gamma voltage generator to generate the gamma voltage set by distributing a plurality of gamma reference voltages by a second resistance string; and a voltage selector to select the compensation voltage set in a threshold voltage compensating period for a driving transistor and to select the gamma voltage set in a pixel data writing period.

18. The panel driving device as claimed in claim 17, wherein:

the first resistance string includes a plurality of resistances connected in series, magnitudes of the resistances of the first resistance string are substantially equal to each other, the second resistance string includes a plurality of resistances connected in series, and magnitudes of the resistances of the second resistance string are different from each other.

19. The panel driving device as claimed in claim 16, wherein the data driver includes:

a shift register to shift a horizontal start signal synchronizing a data clock signal to generate a sampling signal;

a latch circuit to latch input data based on the sampling signal and to output the latched input data based on a load signal;

a digital-analog converter to set the reference voltage based on the compensation voltage set and to convert the latched input data to the pixel data voltage based on the gamma voltage set; and an output buffer to output the reference voltage or the pixel data voltage.

20. An organic light emitting display device, comprising:

a display panel including a plurality of pixels; and a panel driving device configured to drive the display panel, wherein the panel driving device includes:

a voltage generator to generate a compensation voltage set and a gamma voltage set independently from one another based on different resistor strings, the compensation voltage set including a plurality of compensation voltages having a first voltage distribution to compensate for one or more driving transistor threshold voltages, the voltage generator to output the compensation voltage set during a threshold voltage compensating period in which a threshold voltage of a driving transistor included in each of the pixels is compensated, and to output the gamma voltage set during a pixel data writing period in which a pixel data voltage provided to the pixels, the gamma voltage set including a plurality of gamma reference voltages having a second voltage distribution different from the first voltage distribution; and a data driver to determine a reference voltage based on the compensation voltage set and a register value, to output the reference voltage to the display panel during the threshold voltage compensating period, to convert input data into the pixel data voltage based on the gamma voltage set, and to output the pixel data voltage to the display panel based on the gamma voltage set during the pixel data writing period.

* * * * *